US008878738B2

(12) United States Patent
Chang et al.

(10) Patent No.: US 8,878,738 B2
(45) Date of Patent: Nov. 4, 2014

(54) TUNABLE ANTENNA INTEGRATED SYSTEM AND MODULE THEREOF

(75) Inventors: Ching-Wei Chang, New Taipei (TW); Cheng-Han Tsai, New Taipei (TW); Yen-Chao Li, Taoyuan County (TW)

(73) Assignee: Auden Techno Corp., Taoyuan County (TW)

( * ) Notice: Subject to any disclaimer, the term of this patent is extended or adjusted under 35 U.S.C. 154(b) by 259 days.

(21) Appl. No.: 13/474,383

(22) Filed: May 17, 2012

(65) Prior Publication Data

US 2013/0307739 A1 Nov. 21, 2013

(51) Int. Cl.
*H01Q 9/00* (2006.01)
*H01Q 23/00* (2006.01)

(52) U.S. Cl.
USPC ..... 343/745; 343/750

(58) Field of Classification Search
USPC ..... 343/745, 750, 850, 860; 455/150.1, 77, 455/193.1, 121
See application file for complete search history.

(56) References Cited

U.S. PATENT DOCUMENTS

| | | | | |
|---|---|---|---|---|
| 4,862,516 | A * | 8/1989 | Macnak et al. | 455/193.1 |
| 7,764,932 | B2 * | 7/2010 | Rofougaran et al. | 455/77 |
| 8,358,989 | B2 * | 1/2013 | Kakuya et al. | 455/193.1 |
| 8,620,236 | B2 * | 12/2013 | Manssen et al. | 455/121 |
| 2012/0003947 | A1 * | 1/2012 | Su et al. | 455/150.1 |

* cited by examiner

*Primary Examiner* — Hoang V Nguyen
(74) *Attorney, Agent, or Firm* — Li & Cai Intellectual Property (USA) Office

(57) ABSTRACT

The tunable antenna integrated system may include a tunable antenna module, a bias module, a direct current control module, and a RF module. The tunable antenna module may include a tunable capacitor and an antenna. The tunable capacitor may have the capacitance thereof adjusted according to an adjusting voltage. A resonant frequency of the antenna is controlled by the tunable capacitor. The bias module has a digital/analog converter for receiving a control voltage to generate the adjusting voltage, and the adjusting voltage may be outputted to the tunable capacitor with the value thereof larger than that of the control voltage. The direct current control module is connected to the bias module for outputting the control voltage to the digital/analog converter. The RF module is connected to the bias module, and a RF signal is transmitted between the tunable antenna module and the RF module through the bias module.

9 Claims, 4 Drawing Sheets

TUNABLE ANTENNA INTEGRATED SYSTEM AND MODULE THEREOF

BACKGROUND OF THE INVENTION

1. Field of the Invention

The instant disclosure relates to an antenna; in particular, to a tunable antenna integrated system and a module thereof.

2. Description of Related Art

As an antenna serves as an indispensable component of a wireless communication system, the operating frequency and the bandwidth of the antenna as primary parameters thereof dictate the potential performance of the communication system. The operating frequency could hinge on the structure of the antenna while the bandwidth could largely depend on the match of the impedance between the antenna and the radio frequency circuit. It is time-consuming for the antenna engineer to adjust the operating frequency (or so-called resonant frequency) and the bandwidth of the antenna for the purpose of meeting the demands of the wireless communication system.

Generally, when the antenna structure remains the same without any modification, the match of the impedance between the antenna and the radio frequency circuit may be optimized by a matching circuit between the antenna and the radio frequency circuit. However, after the parameters of the matching circuit are determined, the operating frequency and the bandwidth are determined as the result. In order for the antenna structure to be operating in multiple frequency bands, the antenna structure itself and the matching circuit always need to be adjusted, complicating the design of the antenna structure and the antenna module having the same.

SUMMARY OF THE INVENTION

The objective of the instant disclosure is to provide a tunable antenna integrated system and an antenna module. A resonant frequency of the antenna may be adjusted through controlling a digital/analog converter of the tunable antenna integrated system (or a digital/analog converter electrically coupled to a tunable antenna module) by external application program or circuits to provide an adjusting voltage, which in turn may be used to adjust the capacitance of a tunable capacitor of the tunable antenna module.

According to an embodiment of the instant disclosure, a tunable antenna integrated system includes a tunable antenna module, bias module, a direct current control module and a radio frequency module. The tunable antenna module may include a tunable capacitor and an antenna. The tunable capacitor receives an adjusting voltage and has its capacitance adjusted according to the adjusting voltage. The antenna is electrically coupled to the tunable capacitor. A resonant frequency of the antenna is controlled by the capacitance of the tunable capacitor. The bias module is electrically coupled to the tunable capacitor. The bias module has a digital/analog converter for receiving a control voltage to generate the adjusting voltage according to the control voltage. The adjusting voltage is larger than the control voltage. The direct current control module is electrically coupled to the bias module for outputting the control voltage to the digital/analog converter of the bias module. The radio frequency module is electrically coupled to the bias module, and a radio frequency signal is transmitted between the tunable antenna module and the radio frequency module through the bias module.

According to an embodiment of the instant disclosure, a tunable antenna module is offered. The tunable antenna module comprises a tunable capacitor and an antenna. The tunable capacitor receives an adjusting voltage generated by a digital/analog converter. The digital/analog converter generates the adjusting voltage according to a control voltage, and the adjusting voltage is larger than the control voltage. The tunable capacitor changes its capacitance according to the adjusting voltage. The antenna is electrically coupled to the tunable capacitor, and a resonant frequency of the antenna is controlled by the capacitance of the tunable capacitor.

Therefore, the tunable antenna integrated system and module thereof according to embodiments of the instant disclosure has the capacitance of the tunable capacitor to be adjusted upon the receipt of the adjusting voltage by the tunable capacitance. The adjusting voltage may be generated by the digital/analog converter of the tunable antenna integrated system (or a digital/analog converter electrically coupled to the antenna module) according to the control voltage.

In order to further the understanding regarding the instant disclosure, the following embodiments are provided along with illustrations to facilitate the disclosure of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

This instant disclosure modularizes an antenna module and incorporates the same into an electronic system. More specifically, a resonant frequency of an antenna of the antenna module may be tunable by having a radio frequency module of the antenna module and a direct current control circuit (or module) of the electronic system controlled in order to configure an operation mode of the wireless communication. Accordingly, a tunable antenna integrated system may be provided.

Figure 1:
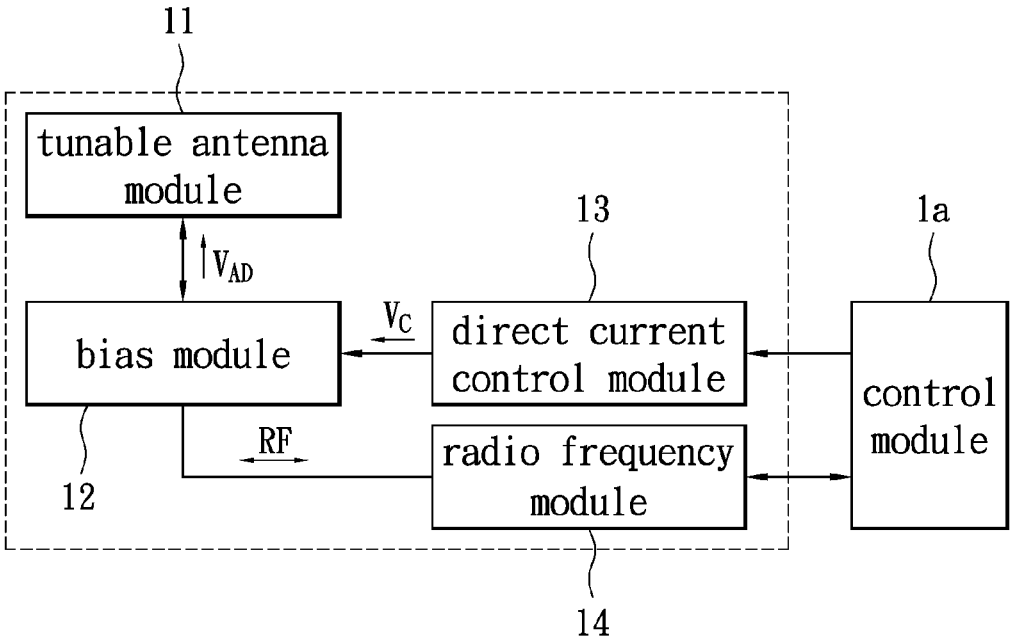
FIG. 1 shows a functional-block diagram of a tunable antenna integrated system according to an embodiment of the instant disclosure.
Figure 2:
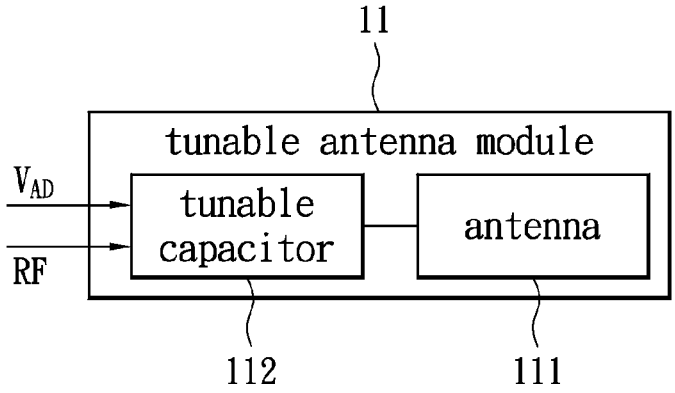
FIG. 2 shows a block diagram of a tunable antenna module according to an embodiment of the instant disclosure.

Please refer to FIG. 1 and FIG. 2. FIG. 1 shows a functional-block diagram of a tunable antenna integrated system 1 according to an embodiment of the instant disclosure, while FIG. 2 shows a block diagram of a tunable antenna module according to an embodiment of the instant disclosure. As shown in FIG. 1, the tunable antenna integrated system 1 is controlled by a control module 1*a*, and the control module 1*a* may be implemented in terms of hardware or software in one implementation. The tunable antenna integrated system 1 may include a tunable antenna module 11, a bias module 12, a direct current control module 13 and a radio frequency module 14. The tunable antenna module 11 may further include a tunable capacitor 112 and an antenna 111, as shown in FIG. 2. The bias module 12 may have a digital/analog converter (not shown in the figure).

The tunable antenna module 11 may be electrically coupled to a bias module 12. The direct current control module 13 and the radio frequency module 14 may be electrically coupled to the bias module 12. The control module 1*a* may be adapted to control the operation mode of the tunable antenna integrated system 1 through controlling the direct current control module 12 and the radio frequency module 14.

The antenna 111 of the tunable antenna module 11 may be electrically coupled the tunable capacitor 112. The electrical coupling between the bias module 12 and the tunable antenna module 11 may be implemented by the bias module 12 electrically coupled to the tunable capacitor 112, which may be adapted to receive an adjusting voltage $V_{AD}$, and have a capacitance thereof adjusted according to the adjusting voltage $V_{AD}$. The capacitance of the tunable capacitor 112 may be from 1 pF to 50 pF, for example. A resonant frequency of the antenna 111 may be controlled by the capacitance of the tunable capacitor 112.

The direct current control module 13 may be utilized for outputting a control voltage $V_C$ to a digital/analog converter (not shown in the figure) of the bias module 12. A radio frequency signal RF is transmitted between the tunable antenna module 11 and the radio frequency module 14 through the bias module 12. According to frequency bands in which the radio frequency module 12 operate, the control module 1*a* may control the control voltage $V_C$ outputted by the direct current control module 13. For example, a resonant frequency of the antenna 111 of the tunable antenna module 11 may range from 0.7 GHz to 0.96 GHz, which as previously presented may be adjustable based on the variation in the capacitance of the tunable capacitor 112. As such, for example, the resonant frequency of the antenna 11 may be at the $13^{th}$ band of the Evolved Universal Terrestrial Radio Access (E-UTRA) ranging 746 MHz to 790 MHz, at the $20^{th}$ band of the E-UTRA ranging from 790 MHz to 862 MHz, or at the band of Global System for Mobile Communications (GSM) ranging from 824 MHz to 894 MHz.

The digital/analog converter of the bias module 12 may be adapted to receive the control voltage $V_C$ and generate the adjusting voltage $V_{AD}$ according to the control voltage $V_C$. The adjusting voltage $V_{AD}$ may be larger than the control voltage $V_C$ in the voltage value. The digital/analog converter may be adapted to convert the digital-based control voltage $V_C$ to the analog-based adjusting voltage $V_{AD}$.

The adjusting voltage $V_{AD}$ for adjusting the capacitance of the tunable capacitor 112 in one implementation is usually in the range of tens of volts (e.g. larger than 20 volts). However, for an electronic device utilizing an antenna, the voltage of the power supplied by the internal circuit of the electronic device may less than the adjusting voltage $V_{AD}$. For example, the voltage supplied by the internal circuit in a notebook is usually at 5 volts. Therefore, the control voltage $V_C$ could be always less than the adjusting voltage $V_{AD}$ when the tunable antenna integrated system is incorporated into the notebook. Furthermore, as the control module 1*a* may be software (i.e. application program) the resonant frequency of the antenna may be adjusted through the manipulation/execution of the application program in order to be in compliance with the frequency bands the tunable antenna integrated system operates.

Figure 3:
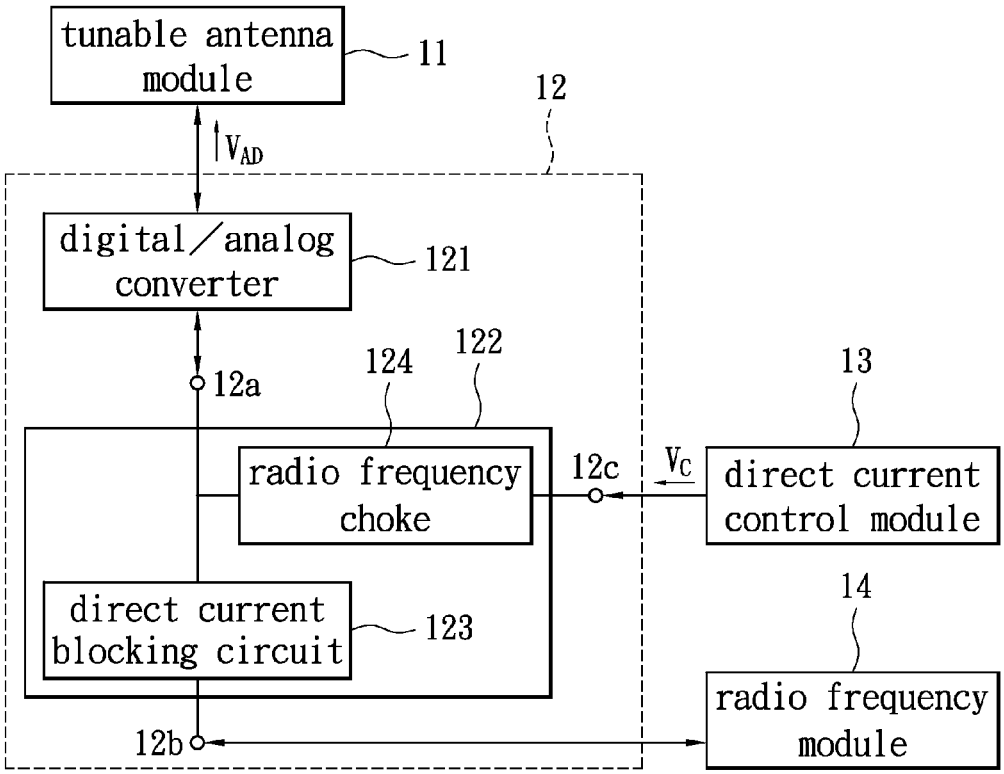
FIG. 3 shows a block diagram of a tunable antenna integrated system according to an embodiment of the instant disclosure.

In conjunction with FIG. 1, FIG. 3 shows a block diagram of a tunable antenna integrated system according to an embodiment of the instant disclosure. As shown in FIG. 3, the digital/analog converter 121 may be connected between the bias tee 122 and the tunable antenna module 11. More specifically, the digital/analog converter 121 may be connected between the tunable capacitor 112 of the tunable antenna module 11 and the bias tee 122. The bias module 12 may include the digital/analog converter 121 and the bias tee 122. The bias tee 122 may include a direct current blocking circuit 123, a radio frequency choke 124, a radio frequency signal terminal 12*b*, a direct current terminal 12*c*, and an output terminal 12*a*.

The radio frequency signal terminal 12*b* may be electrically coupled to the radio frequency module 14. The direct current terminal 12*c* may be electrically coupled to the direct current control module 13. The output terminal 12*a* may be electrically coupled to the tunable antenna module 11 through the digital/analog converter 121. The direct current blocking circuit 123 may be electrically coupled between the radio frequency signal terminal 12*b* and the output terminal 12*a*. The radio frequency choke 124 may be electrically coupled between the direct current terminal 12*c* and the output terminal 12*a*.

Figure 4:
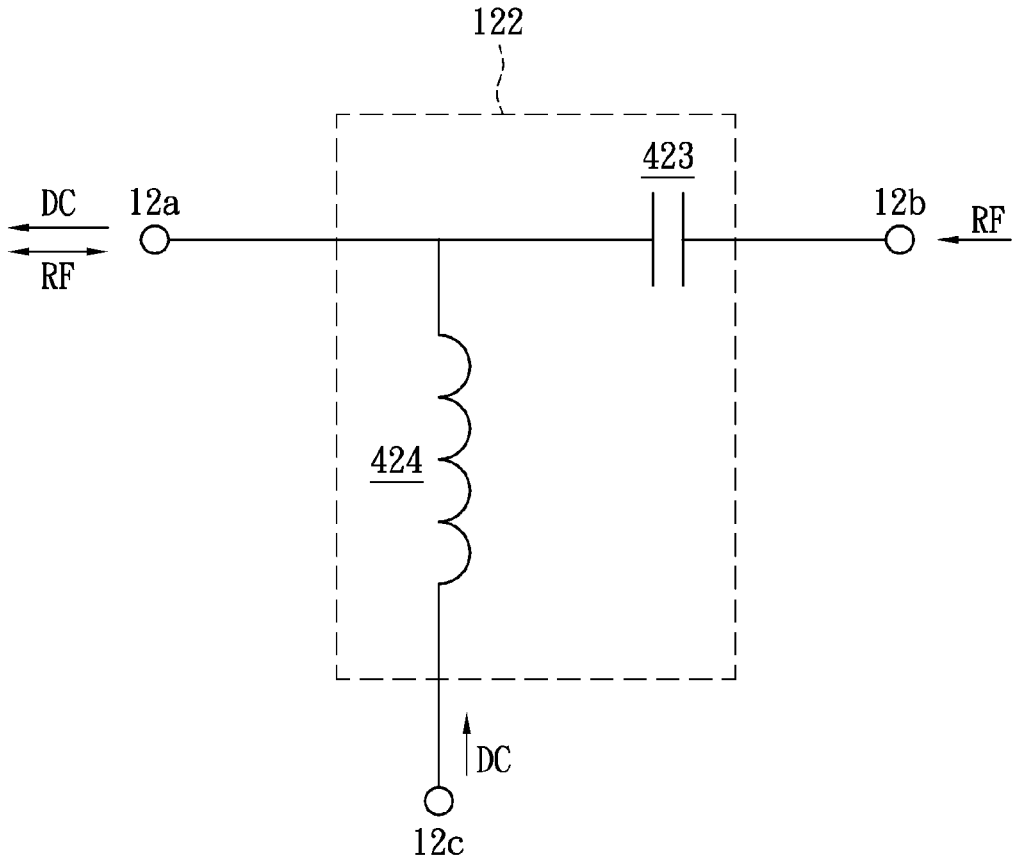
FIG. 4 shows an equivalent circuit diagram of a bias tee according to an embodiment of the instant disclosure.

Referring to FIG. 3 and FIG. 4, FIG. 4 shows an equivalent circuit diagram of a bias tee according to an embodiment of the instant disclosure. The direct current blocking circuit 123 of the bias tee 122 may be considered equivalent to a capacitor 423, which may be capable of allowing for the radio frequency signal RF to pass while blocking the direct current signal DC at the same time. Accordingly, the equivalent capacitor 423 of the direct current blocking circuit 123 may allow for the radio frequency signal RF be transmitted between the output terminal 12*a* and the radio frequency signal terminal 12*b*, while preventing the direct current signal DC, which may correspond to the control voltage $V_C$ in FIG. 3, from being transmitted to the radio frequency signal terminal 12*b*. The radio frequency choke 124 of the bias tee 122 may be represented in terms of an inductor 424, which contrary to the capacitor 423 allows for the direct current signal DC to be transmitted between the output terminal 12*a* and the direct current terminal 12*c*.

Figure 5:
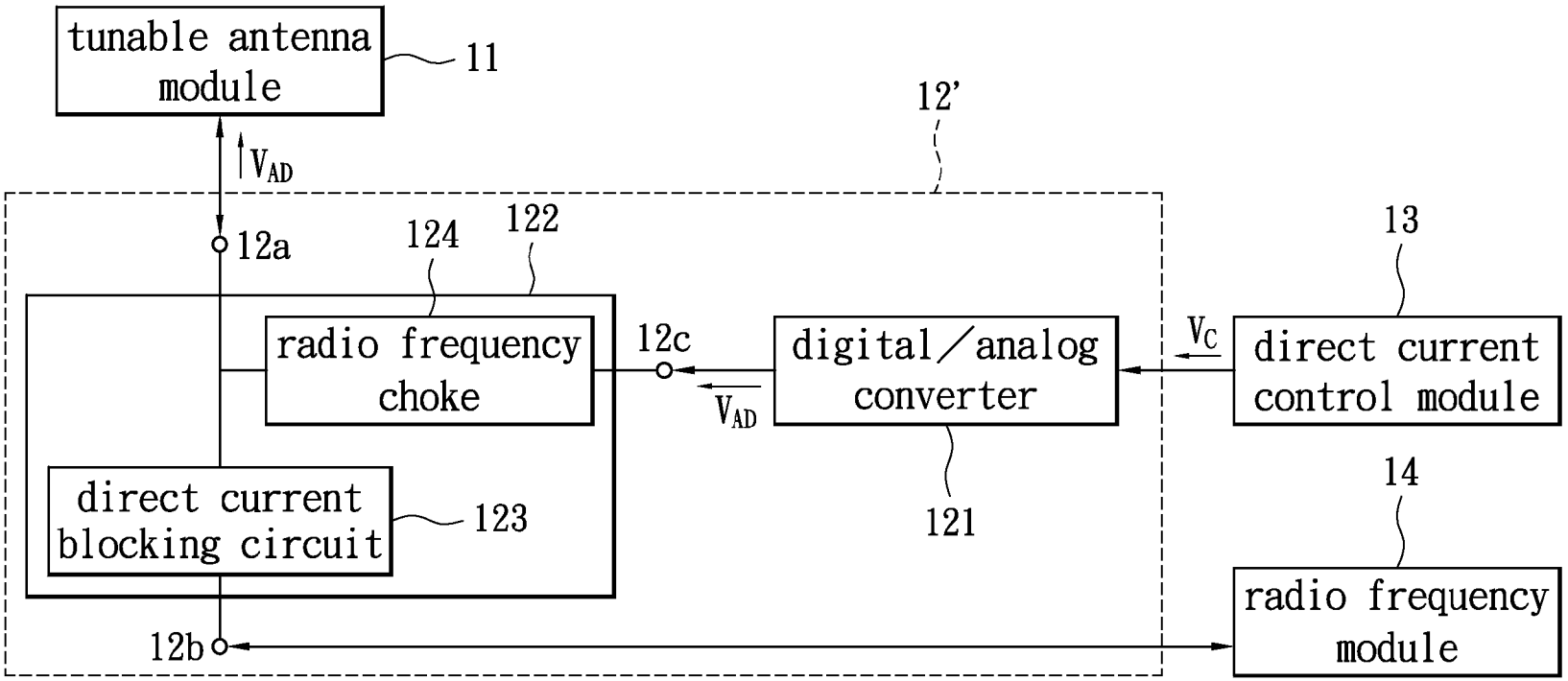
FIG. 5 shows a block diagram of a tunable antenna integrated system according to an embodiment of the instant disclosure.

In conjunction with FIG. 3, FIG. 5 shows a block diagram of a tunable antenna integrated system according to an embodiment of the instant disclosure. As shown in FIG. 5, the digital/analog converter 121 may be connected between the direct current control module 13 and the bias tee 122. Specifically, the digital/analog converter 121 is connected between the direct current control module 13 and the direct current terminal 12*c* of the bias tee 122. Therefore, the adjusting voltage $V_{AD}$ generated by the digital/analog converter 121 could be transmitted to the tunable capacitor 112 of the tunable antenna module 11 through the output terminal 12*a* of the bias tee 122.

In another implementation, the digital/analog converter 121 may be disposed inside the tunable antenna module 11, and connected to the tunable capacitor 112 directly. It is worth noting that the location of the digital/analog converter 121 may vary depending on different designs of the bias module 12'. Thus, the location of the digital/analog converter 121 and therefore the connection relationship of the digital/analog converter are not restricted to what has been shown in FIGS. 3 and 5.

In summary, the tunable antenna integrated system and the tunable antenna module in the aforementioned embodiments renders possible the control over the digital/analog converter of the tunable antenna integrated system or the digital/analog converter connected to the tunable antenna module by an external application program or circuit, in order to achieve the goal of having the capacitance of the tunable capacitor of the tunable antenna module become adjustable, which in turn adjusts the resonant frequency of the antenna in response to the operation mode (or the frequency band) in which the radio frequency module operates. Meanwhile, the digital/analog converter could provide the sufficient adjusting voltage to overcome the disadvantage of the insufficiency in the control voltage provided by the electronic device (e.g. notebook).

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A tunable antenna integrated system, comprising:

a tunable antenna module, comprising:

a tunable capacitor, for receiving an adjusting voltage and therefore adjusting a capacitance of the tunable capacitor according to the adjusting voltage; and an antenna, electrically coupled to the tunable capacitor, with a resonant frequency of the antenna being controlled by the capacitance of the tunable capacitor;

a bias module, having a digital/analog converter, electrically coupled to the tunable capacitor, wherein the digital/analog converter is adapted to receive a control voltage to generate the adjusting voltage according to the control voltage, and the adjusting voltage is larger than the control voltage;

a direct current control module, electrically coupled to the bias module, for outputting the control voltage to the digital/analog converter of the bias module; and a radio frequency module, electrically coupled to the bias module, wherein a radio frequency signal is transmitted between the tunable antenna module and the radio frequency module through the bias module.

2. The tunable antenna integrated system according to claim 1, wherein the bias module further comprises a bias tee, having a radio frequency choke, a direct current blocking circuit, a radio frequency signal terminal, a direct current terminal, and an output terminal, with the radio frequency signal terminal electrically coupled to the radio frequency module, the direct current terminal electrically coupled to the direct current control module, the output terminal electrically coupled to the tunable antenna module, the direct current blocking circuit electrically coupled between the radio frequency signal terminal and the output terminal, and the radio frequency choke electrically coupled between the direct current terminal and the output terminal.

3. The tunable antenna integrated system according to claim 2, wherein the digital/analog converter is electrically coupled between the direct current control module and the direct current terminal of the bias tee.

4. The tunable antenna integrated system according to claim 2, wherein the digital/analog converter is electrically coupled between the tunable antenna module and the output terminal of the bias tee.

5. The tunable antenna integrated system according to claim 1, wherein the direct current control module and the radio frequency module are controlled by a control module, and the control module adjusts the control voltage of the direct current control module according to an operation mode of the radio frequency module for adjusting the resonant frequency of the antenna.

6. A tunable antenna module, comprising:

a tunable capacitor, for receiving a adjusting voltage of a digital/analog converter, wherein the digital/analog converter generates the adjusting voltage according to a control voltage, the adjusting voltage is larger than the control voltage, and a capacitance of the tunable capacitor is adjusted according to the adjusting voltage; and an antenna, electrically coupled to the tunable capacitor, a resonant frequency of the antenna being controlled by the capacitance of the tunable capacitor;

wherein the tunable antenna module is electrically coupled to a radio frequency module through a bias module, and the bias module further comprises:

a bias tee, having a radio frequency choke, a direct current blocking circuit, a radio frequency signal terminal, a direct current terminal and an output terminal, the radio frequency signal terminal being electrically coupled to the radio frequency module, the direct current terminal being electrically coupled to the direct current control module, the output terminal being electrically coupled to the tunable antenna module, the direct current blocking circuit being electrically coupled between the radio frequency signal terminal and the output terminal, and the radio frequency choke being electrically coupled between the direct current terminal and the output terminal.

7. The tunable antenna module according to claim 6, wherein the digital/analog converter is coupled to the direct current terminal of the bias tee, and the bias tee transmits the adjusting voltage from the direct current terminal to the output terminal for transmitting the adjusting voltage to the tunable capacitor.

8. The tunable antenna module according to claim 6, wherein the digital/analog converter is electrically coupled between the tunable capacitor and the output terminal of the bias tee, and the direct current terminal of the bias tee receives the control signal and transmits the control signal to the digital/analog converter through the output.

9. The tunable antenna module according to claim 6, wherein the bias tee is electrically coupled to a radio frequency module through the radio frequency signal terminal of the bias tee, and the digital/analog converter generates the adjusting voltage according to an operation mode of the radio frequency module for adjusting the resonant frequency of the antenna.

* * * * *